US006167196A

United States Patent [19]

Huggins, Jr. et al.

[11] Patent Number: 6,167,196

[45] **Date of Patent: *Dec. 26, 2000**

[54] RADIANT ELECTRIC HEATING APPLIANCE

[75] Inventors: Charles A. Huggins, Jr., Springfield; Kostas Kaplanis, Urbana; Barry W. Smith, Centerville; Larry L. McGrain, Urbana; James B. Johnson, Urbana; Thomas H. Mills, Urbana, all of Ohio

[73] Assignee: The W. B. Marvin Manufacturing Company, Urbana, Ohio

[ * ] Notice: This patent issued on a continued prosecution application filed under 37 CFR 1.53(d), and is subject to the twenty year patent term provisions of 35 U.S.C. 154(a)(2).

[21] Appl. No.: 09/005,320

[22] Filed: Jan. 9, 1998

Related U.S. Application Data

[60] Provisional application No. 60/035,796, Jan. 10, 1997.

[51] Int. Cl.[7] ..... F21V 7/00

[52] U.S. Cl. ..... 392/424; 392/376; 392/373; 392/375; 392/383; 392/422

[58] Field of Search ..... 392/424, 422, 392/376, 373, 375, 383, 407; 219/541, 553; 338/318

[56] References Cited

U.S. PATENT DOCUMENTS

| | | | |
|---|---|---|---|
| 1,824,447 | 9/1931 | Richter . | |
| 2,260,308 | 10/1941 | Fidler . | |
| 2,477,803 | 8/1949 | Huber . | |
| 2,553,875 | 5/1951 | Shaw . | |
| 2,927,299 | 3/1960 | Lefebvre . | |
| 3,113,174 | 12/1963 | Spiteri . | |
| 3,253,243 | 5/1966 | Martin . | |
| 3,278,722 | 10/1966 | Fannon, Jr., et al. . | |
| 3,558,964 | 1/1971 | White | 313/627 |
| 3,862,397 | 1/1975 | Anderson et al. . | |
| 3,946,353 | 3/1976 | Gallagher . | |
| 4,103,277 | 7/1978 | Griffin et al. . | |
| 4,123,743 | 10/1978 | Eaton, Jr. et al. . | |
| 4,426,570 | 1/1984 | Hikino et al. | 219/553 |
| 4,486,639 | 12/1984 | Mittelsteadt . | |
| 4,493,960 | 1/1985 | Mittelsteadt et al. . | |
| 4,523,177 | 6/1985 | Driggers | 338/303 |
| 4,531,047 | 7/1985 | Canfield et al. | 338/268 |
| 5,066,852 | 11/1991 | Willbanks | 219/544 |
| 5,091,632 | 2/1992 | Hennecke et al. | 219/553 |
| 5,296,685 | 3/1994 | Burstein et al. | 219/534 |
| 5,296,686 | 3/1994 | Ullrich et al. | 219/553 |
| 5,652,826 | 7/1997 | Mills . | |
| 5,867,630 | 2/1999 | Kreuter et al. | 392/407 |
| 5,907,663 | 5/1999 | Lee | 392/407 |

OTHER PUBLICATIONS

Advertisement for quartz modular heaters, published by Tansun Quartz Heat Divison, Tunnel Road., Hill Top, West Bromwich, West Midlands,B70 ORD, at least as early as Sep. 10, 1993.

*Primary Examiner*—Teresa Walberg
*Assistant Examiner*—Vinod D. Patel
*Attorney, Agent, or Firm*—Roger S. Dybvig

[57] ABSTRACT

A portable electric space heater having a power cord with a male electrical plug and having easily replaceable quartz heating elements so that an unskilled person can remove and replace a heating element with a minimum of time, tools and skill. The heating elements are removably mounted by sockets within the heater housing behind a grill. One edge of the grill is pivotally connected to the housing and an opposite edge is connected to the housing by a latch member formed on the grill. Access to the heating elements can be obtained by unlatching the grill using the male plug as a tool.

8 Claims, 3 Drawing Sheets

RADIANT ELECTRIC HEATING APPLIANCE

CROSS-REFERENCE TO RELATED APPLICATION

This application claims the benefit of of co-pending U.S. Provisional Application No. 60/035,796, filed Jan. 10, 1997.

FIELD OF THE INVENTION

This invention relates to a radiant electric heating appliance having quartz heating elements. The invention is most important for use in upright radiant electric heating appliances in which the heating elements are vertically oriented but can also be used in horizontal quartz heating appliances in which the heating elements are horizontally oriented.

INCORPORATION BY REFERENCE

U.S. Pat. No. 5,437,001 is hereby incorporated by reference herein. This patent is hereafter referred to as "the '001 patent.".

BACKGROUND OF THE INVENTION

A quartz heating element comprises an elongate, coiled resistance heater wire housed inside a hollow, heat-radiating quartz tube. The particular heating appliance shown in the '001 patent has two vertically-oriented quartz tubes arranged side-by-side, the ends of which are received in pairs of pockets in respective upper and lower ceramic insulators. Cold wires or rods welded to the ends of the heater wires and extending through the ceramic insulators provide connection to a source of household electrical power. One end of each heating element is connected to a suitable power switch operable so that only one or else both of the heating elements can be energized in order to provide different heating levels.

Many models of portable space heaters have horizontally-oriented quartz heating elements. In operation of the heating elements, the resistance heater wires become soft and elongated. In use, the heated resistance wires in horizontally-oriented quartz heating elements relax and may partly rest harmlessly against the quartz tubes. During use of a vertically-oriented quartz heating element, the turns of the coils of the softened resistance wires lower through the tube and some of the coil turns rest on lower coil turns. In time, some of the insulating coating on the resistance wires may deteriorate due to abrasion and electrical shorts between coil turns may occur, causing localized parts of the resistance wires to become hotter than other parts. In consequence, it is not uncommon for a vertically-oriented resistance wire to fail to operate with advantage after a few heating seasons. Replacement of worn out heating elements is possible but requires the services of a skilled technician with proper tools, knowledge and replacement components. In practice, heating elements are probably rarely replaced so that the useful life of a portable space heater employing them is limited to the useful life of the heating elements.

Portable radiant space heaters are now being provided with guards or grills that are pivotally mounted along one edge thereof to the heater housing and releasably connected along its opposite edge to the housing. This construction enables a user to easily pivot the grill to enable access to the reflector for cleaning purposes. The Underwriters' Laboratories, Inc. (UL) requires that the connection of a releasable guard or grill cannot be manually disconnected without the use of a tool, and portable space heaters are now being provided that require the use of a screw driver to disconnect the grill connection. It is reasonable to expect that the person who disconnects the grill will proceed cautiously to clean the reflector. However, there are occasions, such as will be described below, when it would be desirable to better ensure that the heater is not connected to an electrical energy source when the grill is pivoted out-of-the-way.

SUMMARY OF THE INVENTION

An object of this invention is to provide a portable space heater having easily replaceable quartz heating elements so that an unskilled person can remove a poorly performing or inoperative heating element and replace it with a new heating element with a minimum of time, tools and skill.

Another object of this invention is to provide quartz heating elements which are readily replaceable.

Another object so to provide receptacles for quartz heating elements which enable the quartz heating elements to be readily replaceable.

Yet another object of this invention is to provide an electrically-operated appliance having an electrical connector plug at the end of a power cord and further having a component covered by a guard or grill with a latch that prevents removal or partial removal of the guard or grill, which latch can be unlatched using the plug at the end of the power cord as a tool.

More specifically, an object of this invention is to provide a portable space heater having a power cord with a male electrical connector plug and having a pivotally-mounted guard or grill, one edge of which is removably connected to the heater housing by a latch that can be unlatched by manipulation of the male connector plug.

Other objects and advantages will become apparent from the following description and the drawings.

DETAILED DESCRIPTION

The several aspects of this invention may be used with radiant electric heaters of various constructions, including both vertical and horizontal heaters. For convenience, the aspects of this invention are disclosed for use with the type of heater shown in the '001 patent and reference numbers applied to many of the parts of a heater in accordance with the present invention are the same, or nearly the same, as the reference numbers used for corresponding parts of the heater shown in the '001 patent. Heaters of the type illustrated in the '001 patent are currently being marketed by the W. B. Marvin Manufacturing Company of Urbana, Ohio, under its model no. 2020. There are differences between the current model and the model shown in the '001 patent, such as changes in materials, omission of the buzzer, and relocation of the thermal limiter to the top wall of the reflector assembly so that it can be accessed through a hole in the top cap. However, the several aspects of this invention may be used to modify the model shown in the '001 patent as well as the current model or, for that matter, many different models of heaters.

Figure 1:
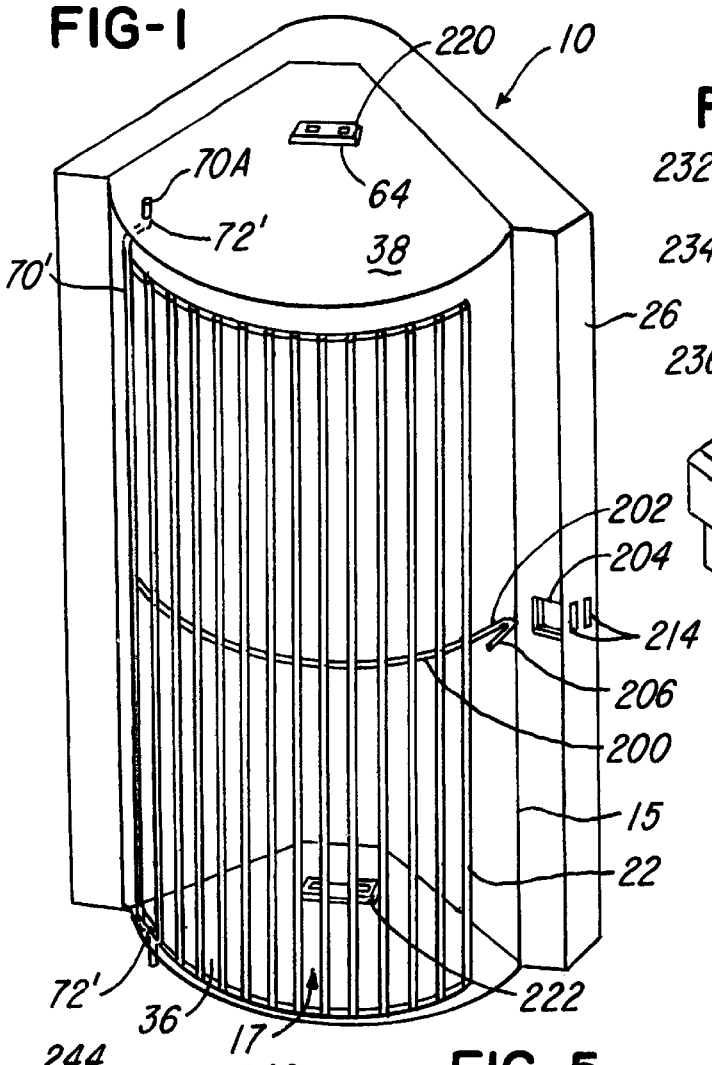
FIG. 1 is a fragmentary, simplified perspective view of a portion of a heating appliance in accordance with this invention.
Figure 2:
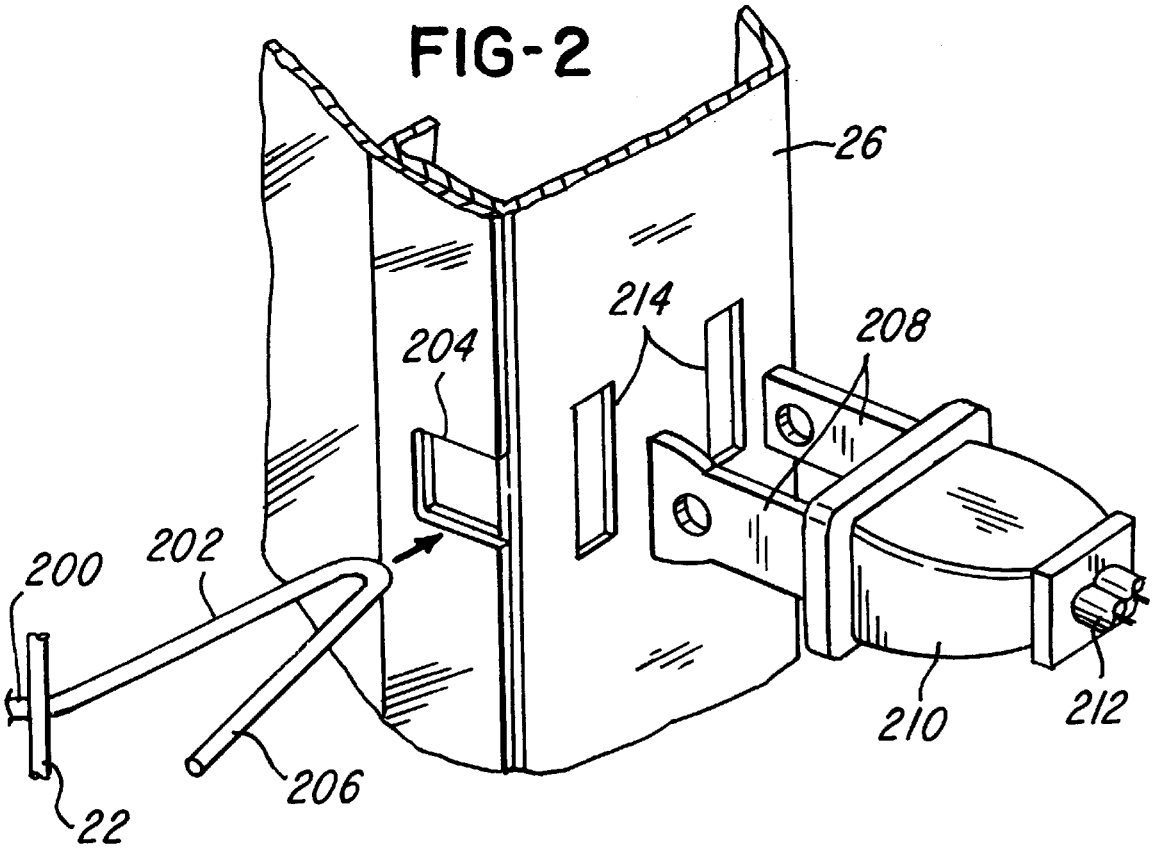
FIG. 2 is an enlarged, fragmentary perspective view of a portion of the heating appliance of FIG. 1.
Figure 3:
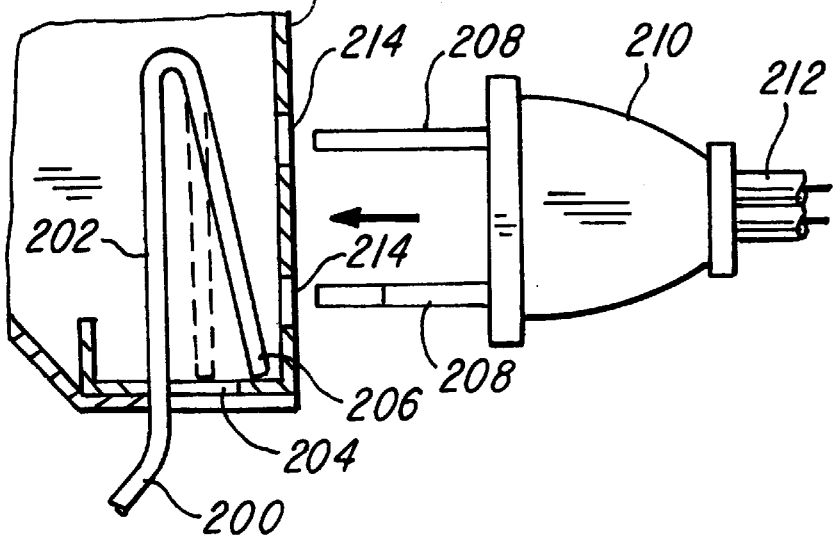
FIG. 3 is a fragmentary cross-sectional view of the heating appliance of FIG. 1 and also shows a fragment of a power cord for the heating appliance.

With reference to FIGS. 1–3, in accordance with one aspect of this invention, an upright radiant electric heater includes a front grill 22 pivotally mounted along one side edge thereof to the rear housing panel or outer wrapper 26 and a latch connecting the opposite side edge of the grill 22 to the outer wrapper 26 that can be manipulated by the male electrical connector plug at the end of the power cord for the appliance and to provide for the modification of the outer wrapper to enable access by the power plug to the latch.

The grill 22 is pivotally mounted on its left side (as viewed from the front) by an elongated vertical grill pivot wire 70' which extends through holes 72' in the top reflector wall 38 and the bottom reflector wall 36.

The upper end, designated 70A, of the vertical grill pivot wire 70' above the top reflector wall 38 is formed at substantially a right angle so as to suspend the grill 22 from the top reflector wall 38. As is apparent, the entire grill 22 can be pivoted about the vertical centerline of the vertical grill pivot wire 70'.

FIGS. 1–3 also show an elongated, horizontal grill latch wire 200 having a latch hook 202 formed at its right end which, when the heating appliance 10 is in use, extends through a wire-entry hole 204 in the overlapped right side margins of the vertically-extending reflector 15 and the outer wrapper 26. FIG. 1 is highly simplified and does not show other horizontal grill wires but there would normally be others, as is shown in the '001 patent. The horizontal and vertical grill wires, which may be made from bright steel, are welded to one another so that the grill 22 constitutes a reasonably solid, unitary construction.

The latch hook 202 is formed by folding a short length of the horizontal grill latch wire 200 at its extreme right end through nearly 180 degrees, so that there is a short latch arm, designated 206, extending to the left and engaged or nearly engaged with the rear face of the rightmost margin of the outer wrapper 26. The inherent resiliency of the grill latch wire 200 causes the latch arm 206 to be biased toward the front of the heater, out of alignment with the wire-entry hole 204 through which the grill latch wire 200 extends.

In order to unlatch the grill 22 to enable the grill 22 to be pivoted to an open position and provide access to the heating chamber 17 for cleaning or for replacing the heating elements, as will described below, the prongs 208 of the male electrical connector plug 210 at the end the power cord 212 for the heater 10 are inserted through apertures 214 in the outer wrapper 26 which are designed to receive the prongs 208. The ends of the prongs 208 can thereby engage the latch arm 206 and push it into alignment with the wire-entry hole 204 so that the grill 22 can be pivoted about the vertical grill pivot wire 70' to an open position. In practice, consumers will be advised to remove the connector plug from the female house-current receptacle before opening the grill 22 and to use the plug 210 as a tool to release the grill 22 for pivotal movement. Thus, the consumer will find it convenient to remove the appliance from the source of electrical current before opening the grill, and will be unlikely to suffer injury due to electrical shock while working on the heater. It will, of course, be apparent that, if the appliance were provided with a plug having three prongs, there would be three prong-receiving apertures 214.

Figure 4:
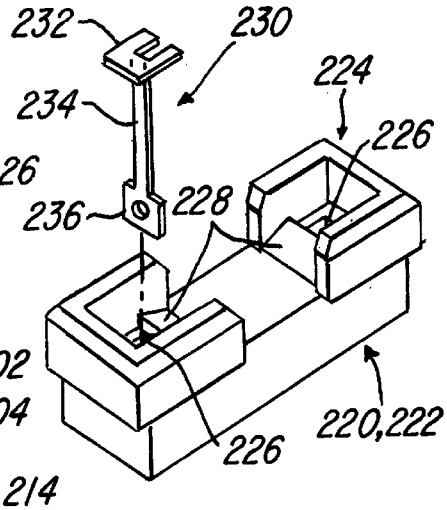
FIG. 4 is a simplified, exploded, perspective view of a receptacle for a heating element usable in the heater of FIG. 1.

With reference to FIGS. 1 and 4, further in accordance with this invention, the heater 10 has a pair of heating element socket assemblies, namely an upper assembly 220 and a lower assembly 222, each of which includes a socket body 224 made from a suitable machined or molded ceramic electric insulating material and copper or other electrically conducting terminals members 230. The two socket assemblies 220 and 222 may be of mutually identical construction. The upper socket assembly 220 is preferably connected to the top reflector wall 36 by any suitable means, such as by protuberances (not shown) on its socket body 224 that create a snap fit with the margins of the elongate opening 64 in the top reflector wall 38 in which the upper socket body 224 is received. The bottom socket assembly 222 can similarly be connected to the bottom reflector wall 36.

Each socket body 224 includes two recesses or pockets 226 for receiving the ends of quartz heating elements 58', as will be described below, and two ramp-like surfaces 228 leading from near the longitudinal center of the socket body 224 to the inside margins of the respective pockets 226.

There is a terminal 230 in the base of each pocket, only one of which is shown in FIG. 4 226. Each terminal 230 preferably has a plate-like contact portion 232 located in and substantially covering the base of its associated pocket 226, and a terminal connector portion 234 extending through the base of the socket body 224 and having a spade connecting end portion 236 to which electrical wiring is connected by means of a crimped terminal connector.

Figure 5:
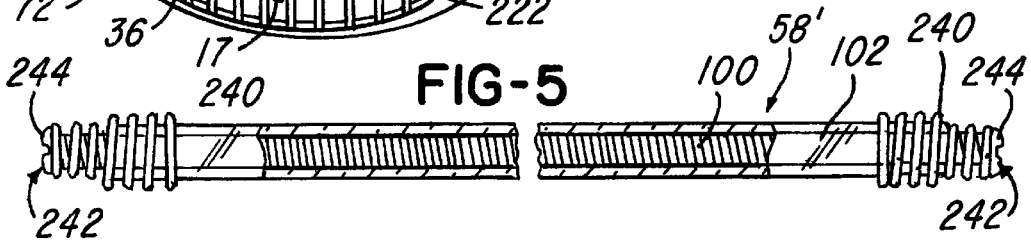
FIG. 5 is a fragmentary side elevational view, with parts in cross-section, of a quartz heating element in accordance with this invention.
Figure 6:
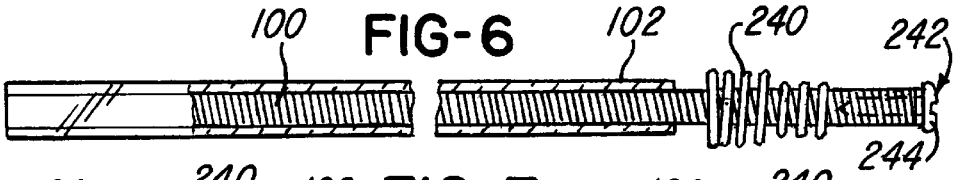
FIG. 6 is a view similar to FIG. 5 that illustrates a stage in the manufacture of the heating element in FIG. 5.
Figure 7:
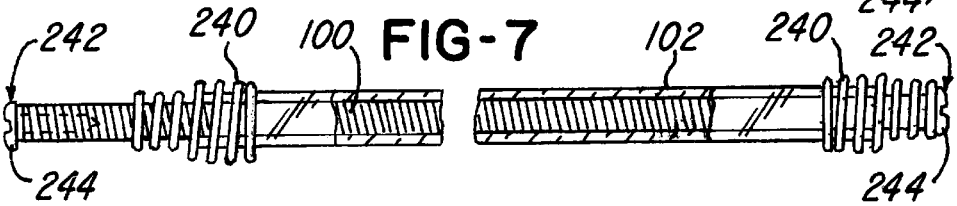
FIG. 7 is a view similar to FIGS. 5 and 6 that illustrates another stage in the manufacture of the heating element of FIG. 5.

FIGS. 5, 6 and 7 show the presently preferred construction of a quartz heating element, generally designated 58', in accordance with this invention. Each heating element 58' comprises an elongate, coiled resistance heater wire 100 located inside a hollow heat-radiating quartz tube 102. The two ends of the heater wire 100 each extended through a short coil spring member 240 having a larger diameter portion coiled about the end of the quartz tube 102 and a smaller diameter portion extending from the end of the quartz tube 102 in alignment therewith. A stainless steel screw 242 or similar threaded element extends through the coil spring 240 and is threadedly engaged inside the adjacent end of the coiled resistance heater wire 100. The inherent bias of the coiled resistance heater wire 100 holds the heads 244 of the screws 242 against the outer, free end of the springs 240 while, at the same time, the springs 240 push against the heads 244 of the screws 242 to thereby apply a slight tension to the coiled resistance heater wires 100 to obtain the noise reduction discussed in the '001 patent.

By now, it should be evident that the quartz heating elements 58' are held between two aligned pockets 226 with the heads 244 biased by the springs 240 at the ends of the quartz tubes 102 into engagement with the terminal portions 232 within the pockets 226. A quartz heating element 58' can be manually removed without the use of tools (after the grill 22 is opened) simply by grasping its quartz tube 102 and pushing the tube 102 upwardly to remove the lower end of the tube 102 from its pocket 226, and then swinging the lower end of the tube away from its pocket 226 whereupon the heating element 58' can be lowered and completely removed. A new quartz heating element 58' can be assembled into the heater 10 by simply inserting one end into a pocket 226 and sliding the opposite end along the confronting ramp-like surface 228 of the opposite socket assembly 222 until the opposite end of the heating element 58' snaps into its associated pocket.

Another advantage of the quartz heating element 58' construction of this invention is that a good electrical connection is created between each screw 242 and the coiled heater wire 100 without resorting to welding. As those familiar with the art are aware, the heater wires are typically made from oxidized nichrome wire which is oxidized to obtain an electrical insulating coating. The oxidation of the nichrome wire, which is done by various proprietary processes, must be done after welding. Using the present invention, the heater manufacturer can purchase the resistance heater wires already oxidized.

Figure 8:
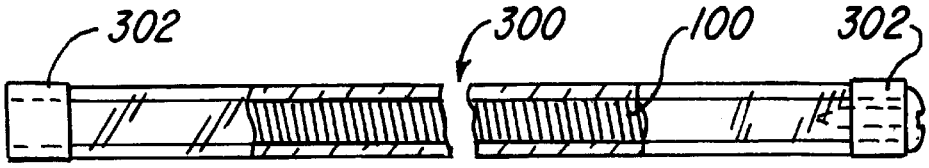
FIG. 8 is a view similar to FIG. 5 of a modified heating element in accordance with this invention.
Figure 9:
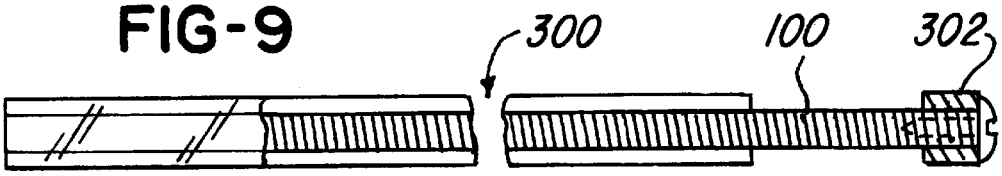
FIG. 9 is a view similar to FIG. 8 that illustrates a stage in the manufacture of the modified heating element of FIG. 8.
Figure 10:
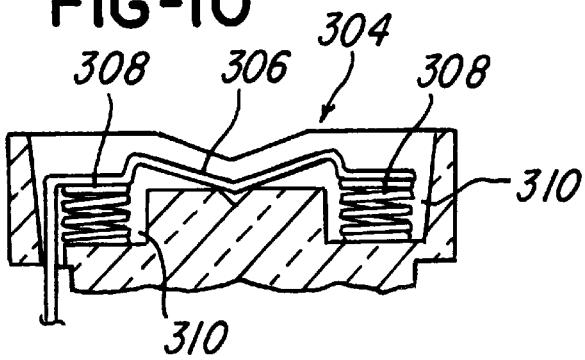
FIG. 10 is a cross-sectional view of a modified receptacle in accordance with this invention.
Figure 11:
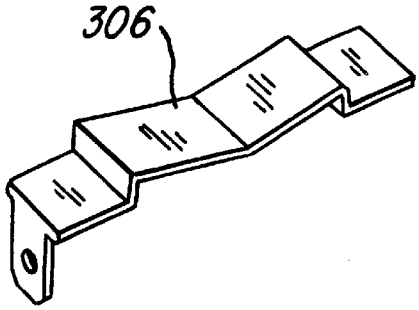
FIG. 11 is a perspective view of a terminal member of the modified receptacle of FIG. 10.
Figure 12:
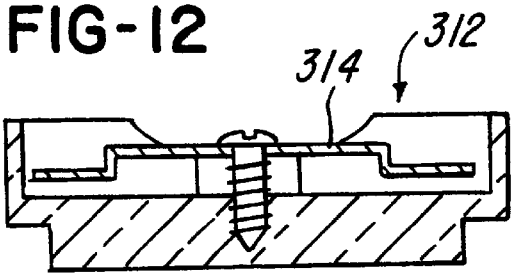
FIG. 12 is a cross-section view of a second modified receptacle in accordance with this invention.
Figure 13:
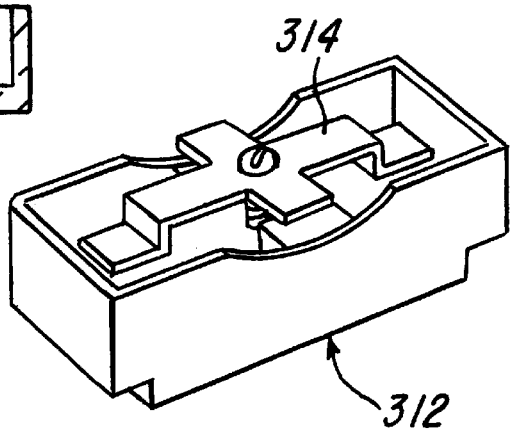
FIG. 13 is a perspective view of the second modified socket of FIG. 12.

FIGS. 8 and 9 show a modified quartz heating element 300 which has fixed ends rather than resilient ends as in the first embodiment of FIGS. 5, 6 and 7, with collars 302 surrounding the ends of the coiled resistance heater wire 100 instead of the springs 240 of the first embodiment. Modified heating elements 300 are intended to be used with sockets having terminals with an inherent spring bias or biased by separate springs. An example of such a socket, designated 304 is shown in FIGS. 10 and 11, has a terminal 306 supported by springs 308 located in heating element-receiving pockets 310 in the socket 304. FIGS. 12 and 13 show a second modified socket 312 having a self-biasing terminal 314. It will be recognized by those skilled in the art that the modified sockets of FIGS. 10 through 13 would be used only at one end of the heating elements. The heating elements of FIGS. 8 and 9 are removable by pushing the heating elements to overcome the spring bias of the terminals 306 or 314 rather than the springs 240 at the ends

Having thus described our invention, we claim:

1. A radiant heater comprising:

an outer wrapper forming a housing panel for said heater;

a wire-entry hole and a pair of apertures formed in said outer wrapper, said wire-entry aperture having a front side and a rear side and said pair of apertures being generally perpendicular to said wire entry hole;

a wire grill;

a latch hook formed from said wire grill insertable into said wire entry hole;

said latch hook being biased slightly out of alignment and toward the front of said wire-entry hole so when said latch hook is inserted into said wire-entry hole, said latch hook is biased to engage an inside surface of said outer wrapper adjacent said wire-entry hole;

a male electrical plug insertable into said pair of apertures in said outer wrapper; and said male plug when inserted into said pair of apertures engages said latch hook biasing said latch hook rearwardly and out of engagement with said wire-entry hole causing said latch hook to disengage from said front of wire-entry hole so said wire grill can be removed.

2. A radiant heater comprising:

a top reflector wall and a bottom reflector wall;

an upper socket assembly and a lower socket assembly;

said upper socket assembly mounted in said top reflector wall and said lower socket assembly mounted in said bottom reflector wall;

each said upper and said lower socket assembly having a socket body;

each said socket body including two pockets for receiving the ends of a quartz heating element;

each said socket body having two ramp-like surfaces;

two terminal members, one in each of said pockets;

a plate-like contact portion located in and substantially covering said pocket;

a terminal connector portion extending through said socket body; and said terminal connector portion having a spade connecting end portion.

3. An electrically-operated appliance having a male electrical connector plug at the end of a power cord and further comprising a housing having a window covered by a grill, said grill having a latch that connects said grill to said housing and constructed to be unlatched using the plug at the end of the power cord as a tool for engaging a portion of the latch.

4. The appliance of claim 3 further comprising a radiant heating assembly mounted in said housing.

5. The appliance of claim 3 wherein said window has a first edge and a second edge spaced from said first edge and said grill is pivotally mounted on said housing along said first edge and removably connected to said housing along said second edge.

6. An electric heater element comprising:

an elongated quartz tube having an opening at each opposing end;

a coiled, elongated, stretchable, heater wire within said quartz tube; and a pair of electrically conductive screws which threadedly engage said heating element wire at each end of said quartz tube.

7. A radiant heater comprising a quartz heating element as recited in claim 6 and a pair of sockets removably receiving said heating element.

8. The radiant heater of claim 7, wherein said sockets are mutually confronting and further comprising terminal members in said sockets and a spring located in one of said sockets biasing the terminal member thereof toward the other one of said sockets.

* * * * *